US009004158B1

(12) United States Patent
Havard

(10) Patent No.: US 9,004,158 B1
(45) Date of Patent: Apr. 14, 2015

(54) SEAL APPARATUS FOR RESTRICTION OF MOVEMENT OF SAND IN AN OIL WELL

(76) Inventor: Kenneth Havard, Houston, TX (US)

( * ) Notice: Subject to any disclaimer, the term of this patent is extended or adjusted under 35 U.S.C. 154(b) by 619 days.

(21) Appl. No.: 13/331,467

(22) Filed: Dec. 20, 2011

Related U.S. Application Data

(63) Continuation-in-part of application No. 12/479,461, filed on Jun. 5, 2009, now abandoned.

(51) Int. Cl.
*E21B 43/00* (2006.01)
*E21B 33/129* (2006.01)

(52) U.S. Cl.
CPC ..... *E21B 33/129* (2013.01)

(58) Field of Classification Search
USPC ..... 166/68, 105; 417/56
See application file for complete search history.

(56) References Cited

U.S. PATENT DOCUMENTS

| | | | | |
|---|---|---|---|---|
| 2,363,644 | A * | 11/1944 | Collins | 166/188 |
| 3,005,506 | A * | 10/1961 | Bus, Sr. | 294/86.34 |
| 3,106,526 | A | 10/1963 | Schmidt | |
| 4,103,739 | A | 8/1978 | Hall | |
| 5,141,411 | A | 8/1992 | Klaeger | |
| 5,295,537 | A | 3/1994 | Trainer | |
| 6,152,218 | A | 11/2000 | Safargar | |
| 6,273,690 | B1 | 8/2001 | Fischer, Jr. et al. | |
| 6,371,206 | B1 | 4/2002 | Mills | |
| 6,619,390 | B1 | 9/2003 | Kellett | |
| 7,757,757 | B1 * | 7/2010 | Vroblesky | 166/192 |
| 8,763,687 | B2 * | 7/2014 | Ingram et al. | 166/187 |
| 2006/0219415 | A1 * | 10/2006 | Xu | 166/387 |
| 2009/0078405 | A1 * | 3/2009 | Moore et al. | 166/85.4 |
| 2010/0254839 | A1 | 10/2010 | Pulliam | |

* cited by examiner

*Primary Examiner* — Kenneth L Thompson
*Assistant Examiner* — Richard Alker
(74) *Attorney, Agent, or Firm* — Egbert Law Offices, PLLC

(57) ABSTRACT

An apparatus for restricting movement of sand in an oil well has a production tubing, a working barrel positioned in the production tubing, a tubular member affixed an end of the working barrel, and a seal extending around the tubular member. The seal is of an elastic or an elastomeric material. The seal has an outer periphery contacting the inner diameter of the production tubing. The seal has a plurality of splits formed therethrough. Each of the splits has a generally V-shaped configuration.

13 Claims, 3 Drawing Sheets

SEAL APPARATUS FOR RESTRICTION OF MOVEMENT OF SAND IN AN OIL WELL

CROSS-REFERENCE TO RELATED APPLICATIONS

The present application is a continuation-in-part of U.S. application Ser. No. 12/479,461 filed on Jun. 5, 2009 and entitled "Brush Apparatus for Restriction of Movement of Sand in an Oil Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the production of oil in an oil well. More particularly, the present invention related to devices for preventing the movement of sand within the production tubing of an oil well.

2. Description of Related Art Including Information Disclosed Under 37 CFR 1.97 and 37 CFR 1.98

In many oil wells, in particularly those in fields that are established and aging, natural pressures decline to the point where the oil must be artificially lifted to the surface. Subsurface pumps are located down in the well below the level of the oil. A string sucker rod extends from the pump up to the surface to a pump jack device, or beam pump unit. A prime mover, such as a gasoline or diesel engine, or an electric motor, or a gas engine on the surface causes the pump jack to rock back and forth, thereby moving the string of sucker rods up and down inside the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges the chamber between the valves with fluid and then lifts the fluid up the tubing toward the surface.

During production of the formation fluid, mineral particles, often referred to as sand, may be swept into the flow path. The sand may erode production components, such as the downhole pump or sucker rod pump, the control valves on the surface, etc. in the flow path. When substantial quantities of sand are carried along as oil and/or gas is removed from a formation, the sand can eventually plug the openings into the interior of tubing by which the hydrocarbon production is withdrawn to the earth's surface. It is not uncommon for the pump itself to stick and/or the barrel to stick as a result of sand or other particulate matter becoming caught between the barrel and the plunger. The tolerances between the barrel and the plunger are close so as to effect a seal between the plunger and the barrel. If sand lodges therebetween, either the plunger or barrel will be cut or the plunger sticks in the barrel. The structure of such pumps makes them particularly prone to such damage because such pumps rely on a seal which is formed between the plunger and barrel by the leading edge of the plunger.

Generally, when the pump becomes "sanded in" in the production tubing, a very complicated procedure is required so as to remove the sanded-in components of the oil well. Typically, the production tubing would have to be removed so as to separate the pump from the tubing and to remove the sand accumulation. As such, it is important that sand be retained, as much as possible, in an area above the plunger and pump so as to prevent these problems from occurring.

In the past, various patents have issued relating to the prevention of sand movement in oil wells. For example, U.S. Pat. No. 3,106,526 issued on Oct. 8, 1963 to B. F. Schmidt, teaches a sand and gas deflector for oil well pumps. In particular, this patent describes an arrangement of baffles or deflectors attached to the production tubing which serve to guard against the entrance of sand from the well into the tubing through the inlet apertures.

U.S. Pat. No. 4,103,739, issued on Aug. 1, 1978 to L. D. Hall, teaches a sand release apparatus for a pump. There is provided a pair of telescoped tubular members threaded into the pump just above the lower end where sands locks the pump. The pair of telescoped tubular members are pinned by a shear pin. When it is time to pull the pump, if there is undue resistance to its removal from the tubing string, the shear pin will shear so as to release the tubular members for telescoping movement.

U.S. Pat. No. 5,141,411, issued on Aug. 25, 1992 to J. H. Klaeger, shows a fluid pump that is used stripper wells. The pump avoids sticking and sanding problems caused in such wells by routing fluid through an annulus between the plunger and the barrel and out of exit ports in order to flush particulate matter with each stroke of the plunger. As the plunger of the pump is reciprocated, the lower bearing surface of the valve member of the traveling valve contacts the upper bearing surface of the valve member of the standing valve when the plunger is near the maximum extent of downward travel to force the traveling valve open and/or force the standing valve closed depending on fluid pressure conditions and whether the standing valve is stuck open.

U.S. Pat. No. 5,295,537, issued on Mar. 22, 1994 to C. W. Trainer, discloses a sand-separating producing-well accessory. The separator causes fluid bearing particulate matter to be accelerated. This acceleration causes the particulate matter to separate from the fluid because of the higher mass and greater inertia of the particulate matter. The fluid, after separation of the particulate matter, is drawn up through the pump. The particulates accumulate within a sand trap which can be pulled from the well and emptied as desired. A strainer is added after the initial inertia separation of particles from the liquid.

U.S. Pat. No. 6,152,218, issued on Nov. 28, 2000 to M. R. Safargar, provides an apparatus for reducing production of particulate material in a well. The apparatus has tubular conduits having openings therein which are protected by flow diversion shields. The flow diversion shields are arranged so that the flow of the production fluids into the tubular conduit is less than the gravitationally-induced falling rate of the particulate matter. This separates a majority of the particulate material from the production fluid.

U.S. Pat. No. 6,273,690, issued on Aug. 14, 2001 to Fischer, Jr. et al., describes a downhole pump with bypass around the plunger. A bypass channel is provided between the barrel and the plunger so as to provide communication around the plunger and its one-way valve. The bypass channel is open when the reciprocal movement is near an end of the upstroke movement. When open, pressure across the plunger can equalize and gas inside the barrel chamber can vent around the plunger and/or pressure can equalize across the plunger one-way valve so as to prevent gas lock and minimize stress on the sucker rods.

U.S. Pat. No. 6,371,206, issued on Apr. 16, 2002 to R. J. Mills, discloses a method and apparatus for unblocking particulate plugs that develop, in a well. A valve is inserted in the production tubing above the pump in order to remove the plugs. The valve permits the well fluid to flow up past the valve but inhibits the well fluid from flowing down past the valve so that a majority of particles that settle from the well fluid when the pump is idle are trapped above the valve and do not plug the pump. A volume of well fluid trapped between the bottom of the valve and the top of the pump permits pressure waves induced by starting and stopping the pump to be generated. The pressure waves force fluids past the valve until the particles in the plug are resuspended so as to permit production to resume.

U.S. Pat. No. 6,619,390, issued on Sep. 16, 2003 to C. W. Kellett, teaches a particle separator for a fluid pump intake. This particle separator has a cylindrical body that is attachable to a pump by a flexible sleeve and has tangential slots directing intake fluid in a swirling manner about an inlet tube within the cylindrical body. The inlet has an enlarged outer diameter at its lower end which causes the swirling inlet fluid to accelerate in order to aid in particle separation.

U.S. Patent Publication No. 2010/0254839, published on Oct. 7, 2010 to K. Pulliam, describes a downhole sucker rod pump having a brush disposed between the downhole pump barrel and the well tubing to provide a seal which is not damaged during the insertion and/or withdrawal of the pump. The bush has a density and stiffness such that it provides a sufficient interference fit between the pump barrel and the well tubing.

It is an object of the present invention to provide a sealing apparatus that prevents sand and rust from collecting at the bottom of the annular space between the working barrel and the production tubing.

It is another object of the present invention to provide a sealing apparatus for an oil well in which minimizes the number of times that the pump has to be pulled for repair.

It is another object of the present invention to provide a sealing apparatus which prevents an accumulation of sand on the pump and which avoids the pump from becoming stuck.

It is another object of the present invention to provide a sealing apparatus for an oil well which allows hydrostatic pressures on opposite sides of the seal to equalize.

It is another object of the present invention to provide a sealing apparatus for an oil well which conforms to irregular shapes of production tubing.

It is another object of the present invention to provide a sealing apparatus for preventing sand It is still a further object of the present invention to provide an apparatus for a pump of an oil well which is easy to install, relatively inexpensive and easy to manufacture.

These and other objects and advantages of the present invention will become apparent from a reading of the attached specification and appended claims.

BRIEF SUMMARY OF THE INVENTION

The present invention is an apparatus for restricting movement of sand in an oil well. The apparatus of the present invention has a production tubing with an inner diameter, a working barrel positioned in the production tubing, a tubular member affixed to an end of the working barrel, and a seal extending around the tubular member. The seal is of an elastic or an elastomeric material. The seal has an outer periphery contacting the inner diameter of the production tubing.

In particular, the seal of the present invention includes an annular member extending around the tubular member. The seal extends radially outwardly of the annular member. The seal extends upwardly from the annular member such that the outer periphery of the seal resides against the inner diameter of the production tubing. The annular member is a ring in compressive contact with the seal.

The seal has at least one split extending therethrough. The split extends from the outer periphery to the ring. In particular, in the preferred embodiment of the present invention, the seal has a plurality of splits formed therein. Each of the plurality of splits has a V-shape with a narrow end with at the ring and a wide end at the outer periphery. The split has a V-shaped configuration when in a planar orientation. The split is generally closed when residing in an upwardly extending orientation against the production tubing.

In particular, the present invention includes a plurality of such seals that are arranged in a stacked configuration. Each of the plurality of seals has at least one split formed therein. The split of the one of the plurality of seals is radially offset from the split of an adjacent seal. In the preferred embodiment of the present invention the seal is formed of a viton material. The seal has a thickness at the ring that is greater than a thickness of the seal at the outer periphery.

The working barrel has a threaded section at an upper end thereof. An upper barrel connector has a lower end in threaded engagement with the threaded section of the working barrel. The upper barrel connector has a threaded portion at an upper end thereof. The tubular member is engaged with the threaded portion of the upper barrel connector.

The present invention also includes a valve rod guide affixed to an end of the tubular member opposite the working barrel. A valve rod extends through an interior of the working barrel and the tubular member. The tubular member defines an annulus with respect to the inner diameter of the production tubing. The seal extends entirely across the annulus so as to allow a flow of fluid through the seal while preventing a passage of sand through the seal. The lower tubular member has a threaded section at a lower end thereof in threaded engagement with the threaded portion of the upper barrel connector. The lower tubular member has a threaded section formed on the narrow diameter section in spaced relation to the wide diameter section. The tubular member has a threaded section formed in the lower wide diameter portion engaged with the threaded section of the narrow diameter section of the lower tubular member.

The present invention is also an apparatus for restricting movement of sand in a production tubing of an oil well. This apparatus includes an annular member and a seal extending radially outwardly of the annular member. The seal is of an elastic or an elastomeric material. The seal has a split extending from the annular member to an outer periphery of the seal. The seal has a thickness adjacent the annular member that is greater than a thickness of the seal at the outer periphery. The split includes a plurality of splits radially spaced from each other. Each of the plurality of splits has a V-shape with a narrow end at the annular member and a wide end at the outer periphery.

The foregoing section is intended to describe the preferred embodiment of the present invention in summary. The language used in this section should not be construed, in any way, as limiting of the scope of the present invention. The scope of the present invention should only be construed in light of the language of attached claims.

DETAILED DESCRIPTION OF THE INVENTION

Figure 1:
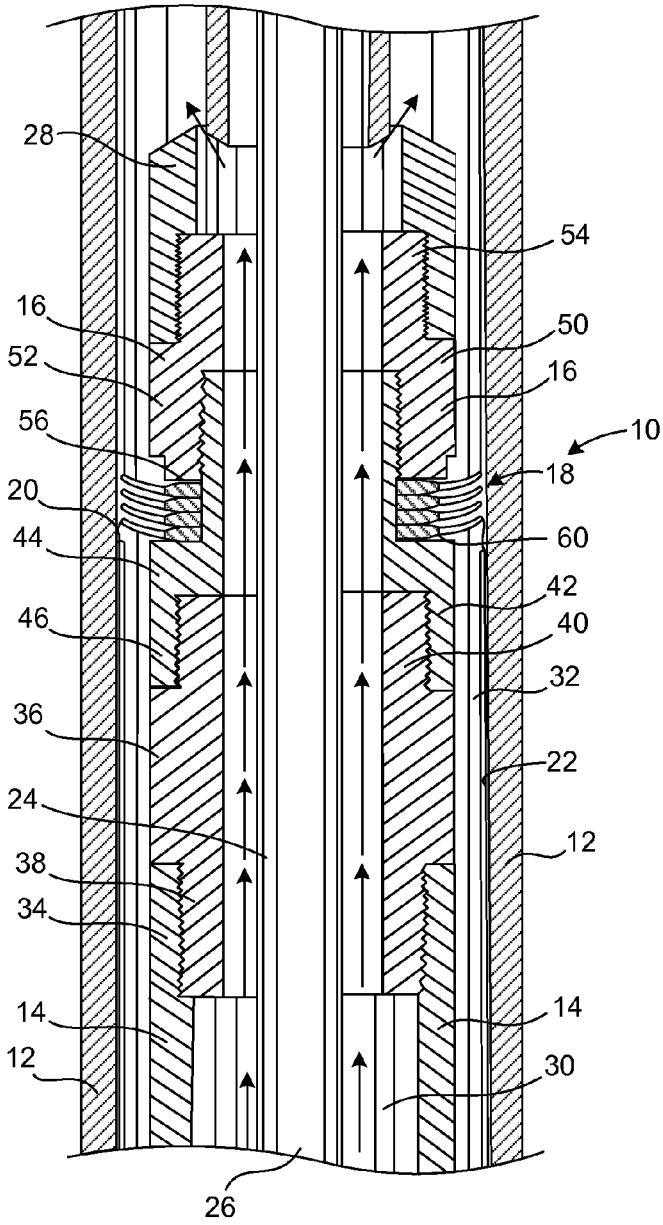
FIG. 1 is a cross-sectional view showing the apparatus of the present invention.

Referring to FIG. 1, there is shown the apparatus 10 for restriction movement of sand in an oil well. The apparatus 10 includes a production tubing 12, a working barrel 14 in the production tubing 12, a tubular member 16 affixed to or interconnected to an end of the working barrel 14 and seal 18 that extends around the tubular member 16. The seal 18 has an outer periphery that extends so as to contact the inner diameter 22 of the production tubing 12.

As can be seen in FIG. 1, there is a shown a valve rod 24 that extends through the interior of the production tubing 12 and in particular, within the interior of the working barrel 14 and the tubular member 16. Conventionally, the valve rod 24 will travel upwardly and downwardly so as to create the pumping motion for the oil well. Typically, a plunger will be connected to the lower end 26 of the valve rod 24 in a conventional manner. There is a valve rod guide 28 affixed to an end of the tubular member 16 opposite the working barrel 14. The valve rod guide 28 allows the valve rod 24 to reciprocate therein. It can be seen in FIG. 1 that the arrows 30 show the flow of oil through the interior of an annulus formed between the valve rod 24 and the inner walls of the working barrel 14, the tubular member 16 and the valve rod guide 28. It can be seen that the fluid will exit into the production tubing 12 through the valve rod guide 28. As such, the fluid, such as oil, will accumulate in the annulus of the production tubing 12 between the tubular member 16 and the inner wall of the production tubing 12. The seal 18 has its outer periphery 20 extending upwardly so as to contact the inner wall 22 of the production tubing 12 so as to prevent the flow of sand particles from passing downwardly from the annulus 32 toward the plunger at the end of the valve rod 24.

It can be seen in FIG. 1 that the working barrel 14 has a threaded section 34 at an upper end thereof. An upper barrel connector 36 has a threaded section 38 at a lower end thereof in threaded connection with the threaded section 34 of the working barrel 14. The upper barrel connector 36 also has an upper threaded section 40 that is engaged with a threaded portion 42 located at the lower end of the tubular member 16. As such, the tubular member 16 can be threadedly interconnected and engaged with the working barrel 14 in a conventional manner.

The tubular member 16 includes a lower tubular member 44 having a wide diameter section 46 and a narrow diameter section 48. The tubular member 16 also includes an upper tubular member 50 that is engaged with the lower tubular member 44. The seal 18 is positioned around the narrow diameter section 48 of the lower tubular member 44.

The upper tubular member 50 has a lower wide diameter portion 52 and an upper narrow diameter portion 54. The seal 18 is retained between the wide diameter section 46 of the lower tubular member 44 and the wide diameter section 52 of the upper tubular member 50. The wide diameter section 46 of the lower tubular member 44 defines a shoulder with respect to the narrow diameter section 48. As can be seen, the seal 18 resides against this shoulder. The lower wide diameter portion 52 of the upper tubular member 50 has an end surface 56 opposite the narrow upper diameter portion 54. The seal 18 resides against this end surface 56. The lower wide diameter portion 52 of the upper tubular member 50 is threaded engaged with threads formed on the narrow diameter section 48 of the lower tubular member 44. As such, the narrow diameter section 48 of the lower tubular member 44 defines an area around which the seal 18 extends. The seal 18 is secured in a proper position such that the outer periphery 20 thereof extends so as to be in contact the inner wall 22 of the production tubing 12. The outer periphery 20 is inclined upwardly toward the inner diameter 22 of the production tubing 12 since the seal 20 has an outer periphery with an outer diameter that is greater than the inner diameter 22 of the production tubing 12. As such, a strong sand-retaining seal is created between the seal 20 and the inner wall 22 of the production tubing 12.

In FIG. 1, it can be seen that the valve rod guide 28 is threaded connection with the upper narrow diameter portion 54 of the upper tubular member 50. As can be seen in FIG. 1, there are plurality of seals 18 that are arranged in a stacked relationship. As such, each of the seals 18 extends outwardly so as to have the outer periphery 20 against the inner wall of the production tubing 12. A total of four seals 18 are illustrated in FIG. 1. However, within the concept of the present invention, more seals or fewer seals could be included and still retain the functional capability of the present invention.

In the present invention, the seal 18 provides a barrier to reduce sand and rust from the inner diameter 22 of the production tubing 12. This barrier prevents particles from collecting at the bottom of the annular space between the working barrel 14 and the production tubing 12. Any particles that would be packed on the top of the sealing mechanism associated with the working barrel can create a problem, as described before. The use of the plurality of seals 18 in the arrangement indicated in FIG. 1 prevents this particulate problem from occurring. When the seals 18 are installed on the pump and the pump is lowered into the production tubing 12, the outer periphery 20 of the seals 18 ride against the inner diameter 22 of the production tubing 12. When the pump is seated, the seals 18 have their outer peripheries 20 inclined upwardly so as to create a barrier to any sand or debris from the produced fluid. The seals 18 have splits formed therein (as will be described hereinafter) will allow fluid to pass while creating a barrier to solid particles. This will allow hydrostatic pressure to equalize on both sides of the seals 18. As such, since the hydraulic pressure is equalized, there will be no pressure on the solid particles to force the solid particles past the seals 18.

It should be noted that most production tubing will always have some rust or scale build-up. The use of the elastic or elastomeric seals 18 conform to the inner diameter 22 of the production tubing 12 regardless of the shape or the condition of the inner diameter 22 of the production tubing 12. When the pump is pulled for repair, the seals 18 will release so that the outer periphery of such seals 18 will incline downwardly.

In FIG. 1, it can further be seen that the seal 18 has the plurality of seals secured to a plurality of annular members 60 so as to present a stacked configuration of such annular members. The annular members 60 are generally coaxial with each other in this stacked arrangement. Each of the annular members retains the seals respectively thereon. The illustration of each of the seals is described in greater detail in association with FIGS. 4-6 herein.

Figure 2:
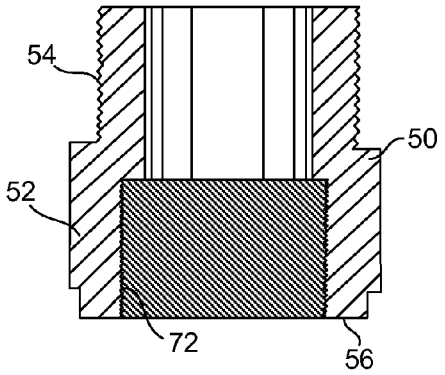
FIG. 2 is a cross-sectional view showing the upper tubular member as used in the apparatus of the present invention.

FIG. 2 is an isolated view of the upper tubular member 50. It can be seen that the upper tubular member 50 has a lower wide diameter portion 52 and a narrow upper diameter portion 54. The narrow lower diameter portion 52 has threads 72 formed on an interior thereof. Threads 72 will engage with the threads formed on the upper end of the lower tubular member 44. It should be noted that an end surface 56 is formed at an end of the lower wide diameter portion 52.

Figure 3:
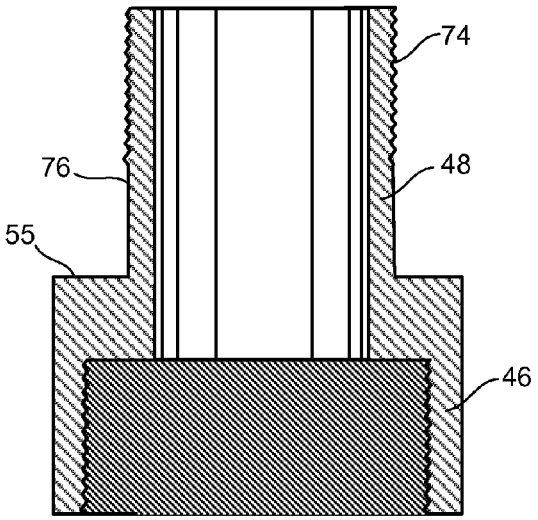
FIG. 3 is a cross-sectional view of the lower tubular member as used in the apparatus of the present invention.

FIG. 3 shows the lower tubular member 44. The lower tubular member 44 has the wide diameter section 46 and the narrow diameter section 48. A shoulder 54 is formed between the wide diameter section 46 and the narrow diameter section 48. It can be seen that shoulder 54 is inclined generally upwardly so as to accommodate the enlarged thickness of the annular member 60 of the seal 18. As such, when the upper tubular member 50 is engaged with the lower tubular member 44, the end surface 56 will suitably cooperate with the shoulder 54 so as to sandwich the annular member 60 of the seal 18 therebetween. Also, in FIG. 3, it can be seen that the narrow diameter section 48 has threads 74 formed at an upper end thereof. Threads 74 will engage with the threads 72 of the upper tubular member 50 so as to allow for an unthreaded section 76 on the narrow diameter section 48 of the lower tubular member 44. This unthreaded section 76 allows for the receipt of the annular member 60 therearound.

Figure 4:
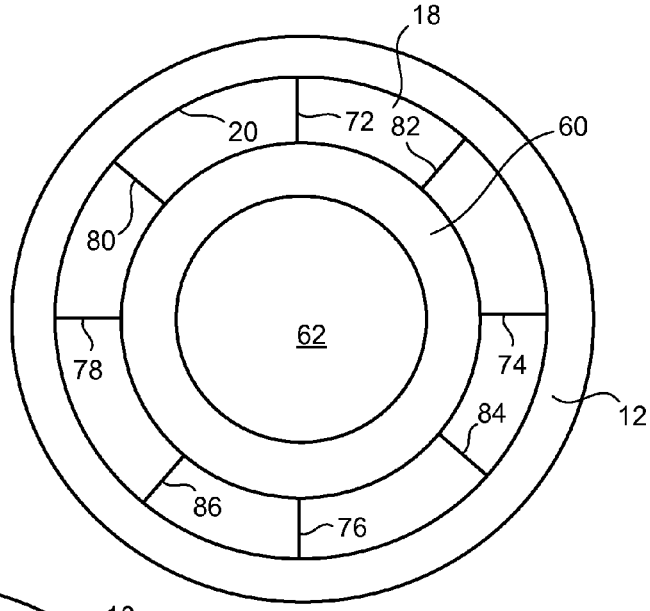
FIG. 4 is a plan view of the seal of the present invention as shown as extending against an inner wall of the production tubing.

FIG. 4 is a plan view showing the configuration of the seal 18 as positioned within the production tubing 12. In particular, the seal 18 is secured to an annular member 60 having an interior 62. The seal 18 has a plurality of splits 72, 74, 76 and 78 formed therethrough. The splits 72, 74, 76, and 78 extend from the outer periphery 20 of seal 18 to the annular member 60. Each of the splits 72, 74, 76, and 78 extends through the thickness of the seal 18. It can be seen that the outer periphery 20 bears against the inner diameter of the production tubing 12.

In FIG. 4, there is illustrated diagrammatically another seal positioned below the seal 18. As can be seen, this seal is positioned directly below seal 18 and has a plurality of splits 80, 82, 84 and 86 therethrough. The splits 80, 82, 84 and 86 are radially offset from the splits 72, 74, 76 and 78 of seal 18. The seals that is located below seal 18 will also have another annular member, such as annular member 60 affixed thereto (and as illustrated in FIG. 1).

It should be noted in FIG. 4 that there are a total of four (4) splits that are formed on the seal 18. Within the concept of the present invention, fewer splits or more splits can be utilized to accomplish the purposes of the present invention. Also, in FIG. 4, it can be seen that when the seal 18 is placed such that the outer periphery 20 is adjacent to the inner wall of the production tubing 12, the splits 72, 74, 76 and 78 are generally closed.

The seal 18 is molded out of high temperature viton 90D with a temperature rating of 475° F. This material is elastomeric that can be effectively used in steam flooding applications. Steam flooding applications are often used for tertiery recovery systems. As such, unlike the prior art, the use of such elastic or elastomeric seals 18 serves to withstand the high temperatures and pressures in such environments.

Figure 5:
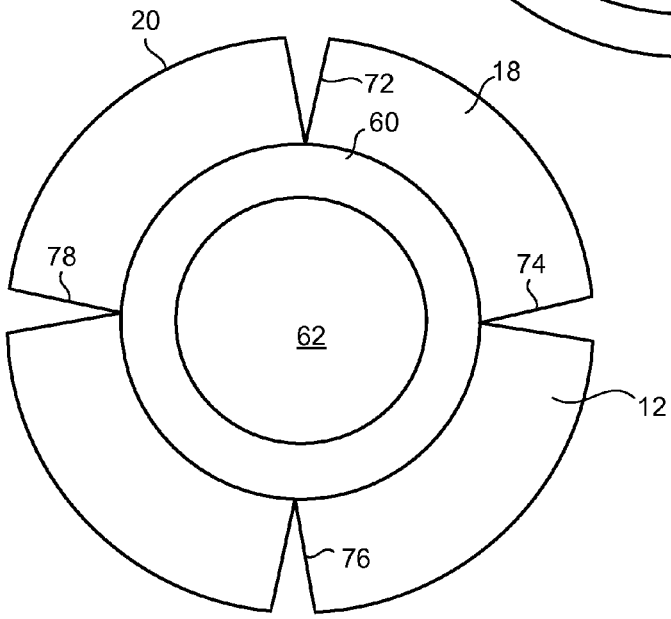
FIG. 5 is a plan of the seal of the present invention as arranged in a planar configuration outside of a production tubing.

FIG. 5 illustrates a single seal 18 as extending outwardly of the annular member 60. In FIG. 5, the seal 18 is illustrated as in a generally planar configuration (prior to installation within the production tubing). It can be seen that the splits 72, 74, 76 and 78 have a generally V-shape. The wide end of the V-shaped is adjacent to the outer periphery 20 of the seal 18. The narrow end of this V-shape is adjacent to the annular member 60. This configuration of the V-shape is chosen such that when the seal 18 is placed into the production tubing, the flexing of the outer periphery 20 upwardly will cause the splits 72, 74, 76 and 78 to move from this V-shape into a closed shape (as illustrated in FIG. 4).

Figure 6:
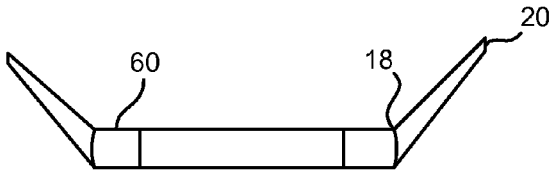
FIG. 6 is a side elevational view of the seal as used in the present invention.

FIG. 6 illustrates a cross-sectional view of the seal 18 as used in the present invention. As can be seen, the seal 18 has its outer periphery 20 extending upwardly at an angle from the annular member 60. The thickness of the seal 18 is less at the outer periphery 20 than it is adjacent to the annular member 60. As such, this decrease in thickness facilitates the flexibility of the seal when installed in the production tubing.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for restricting movement of sand in an oil well, the apparatus comprising:

a production tubing having an inner diameter;

a working barrel positioned in said production tubing;

a tubular member affixed to an end of said working barrel; and a seal extending around said tubular member, said seal being of an elastic or an elastomeric material, said seal having an outer periphery contacting said inner diameter of said production tubing; and an annular member extending around said tubular member, said seal extending radially outwardly of said annular member, said annular member being a ring in compressive contact with said seal, said seal having at least one split extending therethrough, said split extending from said outer periphery to said ring, said split comprising a plurality of said splits formed in said seal, said plurality of splits each having a V-shape with a narrow end at said ring and a wide end at said outer periphery.

2. The apparatus of claim 1, said seal extending upwardly from said annular member such that said outer periphery of said seal resides against said inner diameter of said production tubing.

3. The apparatus of claim 1, said split having a V-shaped configuration when in a planar configuration, said split being closed when residing in an upwardly extending orientation against said production tubing.

4. The apparatus of claim 1, said seal comprising a plurality of seals arranged in a stacked configuration.

5. The apparatus of claim 4, each of said plurality of seals having at least one split formed therein, the split of the one of said plurality of seals being radially offset from the split of an adjacent seal of said plurality of seals.

6. The apparatus of claim 1, said seal having a thickness at said ring that is greater than a thickness of said seal at said outer periphery.

7. The apparatus of claim 1, said working barrel having a threaded section at an upper end thereof, the apparatus further comprising:

an upper barrel connector having a lower end in threaded engagement with said threaded section of said working barrel, said upper barrel connector having a threaded portion at an upper end thereof, said tubular member engaged with said threaded portion of said upper barrel connector.

8. The apparatus of claim 7, said tubular member comprising:

a lower tubular member having a wide diameter section and a narrow diameter section; and an upper tubular member engaged with said lower tubular member, said seal positioned around said narrow diameter section of said lower tubular member.

9. The apparatus of claim 8, said upper tubular member having a lower wide diameter portion and an upper narrow diameter portion, said seal being retained between said wide diameter section of said lower tubular member and said wide diameter section of said upper tubular member.

10. The apparatus of claim 9, said lower tubular member having a threaded section at a lower end thereof in threaded engagement with said threaded portion of said upper barrel connector, said lower tubular member having a threaded section formed on said narrow diameter section in spaced relation to said wide diameter section, said upper tubular member having a threaded section formed in said lower wide diameter portion engaged with said threaded section of said narrow diameter section of said lower tubular member.

11. The apparatus of claim 1, further comprising:

a valve rod guide affixed to an end of said tubular member opposite said working barrel; and a valve rod extending through an interior of said working barrel and said tubular member.

12. An apparatus for restricting movement of sand in an oil well, the apparatus comprising:

a production tubing having an inner diameter;

a working barrel positioned in said production tubing;

a tubular member affixed to an end of said working barrel; and a seal extending around said tubular member, said seal being of an elastic or an elastomeric material, said seal having an outer periphery contacting said inner diameter of said production tubing, said tubular member defining an annulus with respect to the inner diameter of said production tubing, said seal extending entirely across said annulus so as to allow a flow of fluid through said seal while preventing a passage of sand through said seal.

13. An apparatus for restricting movement of sand in a production tubing of an oil well, the apparatus comprising:

an annular member; and a seal extending radially outwardly of said annular member, said seal being of an elastic or an elastomeric material, said seal having a split extending from said annular member to an outer periphery of said seal, said seal having a thickness adjacent said annular member that is greater than a thickness of said seal at said outer periphery, said split comprising a plurality of said splits radially spaced from each other, each of said plurality of said splits having a V-shape with a narrow end at said annular member and a wide end at said outer periphery.

* * * * *